US007854020B2

(12) United States Patent
Ehrlickman

(10) Patent No.: US 7,854,020 B2
(45) Date of Patent: Dec. 21, 2010

(54) SAFETY DRAIN HOLDING SYSTEM

(76) Inventor: Patricia Anne Ehrlickman, 303 Tynemouth Dr., Cary, NC (US) 27513-5578

( * ) Notice: Subject to any disclaimer, the term of this patent is extended or adjusted under 35 U.S.C. 154(b) by 256 days.

(21) Appl. No.: 12/131,102

(22) Filed: Jun. 1, 2008

(65) Prior Publication Data

US 2009/0089913 A1 Apr. 9, 2009

Related U.S. Application Data

(60) Provisional application No. 60/997,406, filed on Oct. 3, 2007.

(51) Int. Cl.
*A41D 13/00* (2006.01)

(52) U.S. Cl. ..... 2/247; 2/338

(58) Field of Classification Search ..... 2/48, 2/51, 52, 338, 247–254, 114, 463, 464, 46, 2/69, 83, 102, 300, 339, 94; 224/663, 664, 224/665, 666, 671, 673, 674, 660; 604/174, 604/179, 345; 128/876, 877, 875, 874
See application file for complete search history.

(56) References Cited

U.S. PATENT DOCUMENTS

| | | | | | |
|---|---|---|---|---|---|
| 2,263,538 | A | * | 11/1941 | Freirich | 2/51 |
| 2,298,600 | A | * | 10/1942 | Stember | 224/587 |
| 2,538,677 | A | * | 1/1951 | Ferrand | 2/48 |
| 2,785,409 | A | * | 3/1957 | Lackey | 2/51 |
| 2,922,165 | A | * | 1/1960 | Krawczyk | 2/51 |
| D191,696 | S | * | 11/1961 | Weil | D3/226 |
| 3,022,786 | A | * | 2/1962 | Nalon | 604/342 |
| 3,367,338 | A | * | 2/1968 | Crandall | 604/345 |
| 4,119,248 | A | * | 10/1978 | Butler et al. | 224/148.3 |
| 4,988,024 | A | * | 1/1991 | Weber | 224/664 |
| 5,285,833 | A | * | 2/1994 | Haxby | 150/102 |
| 5,304,145 | A | * | 4/1994 | Blair | 604/179 |
| 5,496,282 | A | * | 3/1996 | Militzer et al. | 604/179 |
| 5,538,502 | A | * | 7/1996 | Johnstone | 602/79 |
| 5,643,233 | A | * | 7/1997 | Turner | 604/332 |
| 5,779,657 | A | * | 7/1998 | Daneshvar | 602/60 |
| 6,055,668 | A | * | 5/2000 | Gros et al. | 2/69 |
| 6,270,485 | B1 | * | 8/2001 | Ekey | 604/345 |
| 6,273,872 | B1 | * | 8/2001 | Friedman | 604/174 |
| 6,610,032 | B1 | * | 8/2003 | Prody | 604/179 |
| 6,622,899 | B1 | * | 9/2003 | Klindworth-Garron | 224/578 |
| 6,681,404 | B1 | * | 1/2004 | Adlard et al. | 2/94 |
| D544,095 | S | * | 6/2007 | McLaughlin | D24/118 |
| 7,293,295 | B2 | * | 11/2007 | King | 2/114 |
| 7,658,719 | B2 | * | 2/2010 | Bockol et al. | 602/3 |
| 2004/0226073 | A1 | * | 11/2004 | McCullar et al. | 2/114 |
| 2008/0108948 | A1 | * | 5/2008 | Beaver | 604/179 |
| 2008/0312615 | A1 | * | 12/2008 | Hunter | 604/345 |

* cited by examiner

*Primary Examiner*—Amy B Vanatta

(57) ABSTRACT

Safety drain holding systems are disclosed. According to one aspect, a system can include a medical support garment comprising a medical container holder having first and second ends and at least one pocket. The pocket is adapted to support at least one container for storing bodily fluid output from a patient to the container. The medical support garment comprises a belt including first and second ends adapted for releasable attachment to the first and second ends, respectively, of the medical container holder such that the pocket is held adjacent to the waist of the patient when the first and second ends of the belt are attached to the first and second ends, respectively, of the medical container holder.

10 Claims, 5 Drawing Sheets

SAFETY DRAIN HOLDING SYSTEM

RELATED APPLICATION

The presently disclosed subject matter claims the benefit of U.S. Provisional Patent Application Ser. No. 60/997,406, filed Oct. 3, 2007, the disclosure of which is incorporated herein by reference in its entirety.

TECHNICAL FIELD

The subject matter described herein relates to medical equipment. Particularly, the subject matter described herein relates to medical support garments for supporting containers.

BACKGROUND

External drainage devices are commonly attached to a patient's body following surgery. For example after operations performed on a breast cancer patient's breast(s), the operating physician often inserts a drainage tube near the operated areas of the patient's breast to reduce accumulations of post-operative fluids, such as blood, lymph or other bodily fluid, during the convalescence period. The tubes are typically not removed until the drainage output falls to below a predetermined volume per day, such as to below 30 ccs (1 fluid oz).

Generally, these external tubes, often made of rubber or plastic, are secured at one end to a patient's body only by sutures. The other end of the tube is typically connected to a drainage reservoir or container, such as a Jackson-Pratt drain or bulb drain. As such, movements of the tubes can cause tugging or even tearing of the connecting sutures resulting in pain, discomfort or serious injury to the patient. The container's weight and tendency to swing when the patient moves or breathes often exerts detrimental force on the tubes, further delaying the patient's recovery.

To reduce the adverse impacts, patients are asked to restrain the container's movement. One approach is for the patients to hold the container by hand, which reduces the availability of their hands for every day usage. Other approaches include the securing of the container or the tubes to the patient's clothing or hospital gown via a safety pin. These methods leave a large portion of the drainage tubes exposed and thus prone to impact or entanglements with door knobs, handles or other protruding objects, resulting in tugging or tearing of the connecting sutures. In addition, during activities which require both the removal of a patient's garments and the use of patient's hands, such as showering, the patients are often forced to once again, resort to holding the container. Holding the drains makes hands unavailable for bathing and safeguarding against slippage, increasing the patients' risk of shower-related injuries.

Further, when a medical practitioner attaches the container to the patient's clothing or hospital gown, there is a risk that the patient's skin will accidentally be punctured by a safety pin during attachment. Such puncture wounds can be life-threatening if bodily fluid from the injury is transmitted to a medical practitioner. A puncture resulting from a safety pin can increase the risk of infection or the transmission of a blood-borne disease, such as hepatitis or human immunodeficiency virus. Urgent measures must be taken to mitigate the transmission of infections to the patient from the open wound. All needle stick emergency plans can be instituted, yet physical and/or emotional harm can result from the injury.

In pediatric medicine, a safety pin is the current standard of care for securing a Jackson-Pratt drain. This method, already risky, presents more dangers to children than adults. For example, a child may suffer internal bleeding if the safety pin is swallowed. Injury could result from a child who plays with the pin and accidentally scratches or punctures his or her eye. Therefore, it would be beneficial to avoid the use of a safety pin when securing a drain to a patient.

Accordingly, in view of the foregoing, there is a need for providing improved mobility, reduced inconveniences, and reduced risk of bodily harm to both medical practitioners and patients with externally attached drainage containers or devices. There is currently a shirt with pockets placed and sized to hold external tubes for female patients following a mastectomy. But the need for such a garment is not limited to patients who have undergone this type of procedure. Both male and female patients who have undergone abdominal surgery, chest cavity surgery, plastic surgery, and many other types of invasive surgery need a method of holding drainage devices that is safer, more comfortable, and more convenient.

SUMMARY

Medical support garments for supporting containers are disclosed. According to one embodiment, a medical support garment can comprise a medical container holder including first and second ends and at least one pocket. The pocket can be adapted to support at least one container for storing bodily fluid output from a patient to the container. The medical support garment can comprise a belt including first and second ends adapted for releasable attachment to the first and second ends, respectively, of the medical container holder such that the pocket is held adjacent to the waist of the patient when the first and second ends of the belt are attached to the first and second ends, respectively, of the medical container holder.

According to one embodiment, a medical support garment can comprise a medical container holder including first and second ends and at least one pocket. The pocket can be adapted to support at least one container for storing bodily fluid output from a patient to the container. The medical support garment can comprise a belt including first and second ends. The first end of the belt can be permanently attached to the first end of the medical container holder. The second end of the belt can be adapted for releasable attachment to the second end of the medical container holder such that the pocket is held adjacent to the waist of the patient when the second end of the belt is attached to the second end of the medical container holder.

BRIEF DESCRIPTION OF THE DRAWINGS

The subject matter described herein will now be explained with reference to the accompanying drawings of which.

DETAILED DESCRIPTION

A medical support garment for drainage containers is described herein. The garment can be worn around a patient's waist to support one or more containers for storing bodily fluid output from tubes sutured to the patient's wound. A universal medical support garment can reduce the adverse impacts of the movement or weight of the container on wounds from many types of surgeries by stabilizing the container in a pouch designated to hold the container or bulb.

Further, the garment disclosed herein can improve the patient's mobility, reduce the inconvenience of having medical baggage, and reduce their risk of bodily harm. Because one or more containers can be supported by the garment described herein, patients do not have to hold the containers with their hands. Further, the containers do not have to be attached to the patient's clothing or hospital gown by a safety pin, thus reducing the risk of injury to patients. In addition, because the container is held close to the patient's waist, the drain tube can be of minimal length, thus reducing the risk of entanglement of the drain tube with external objects in the patient's path. Further, the medical support garments disclosed herein can be worn underneath other clothing such that the patient can more easily remove other clothing to facilitate bathing. The design of the garment is such that it can be manufactured inexpensively from many fabrics or materials, one easily replaced or waterproof. The garment, of use to surgical patients across all fields, can be of a stock supply on any surgical or recovery floor in a hospital. Inexpensive production can allow for bulk purchases and storage of this item.

Figure 1:
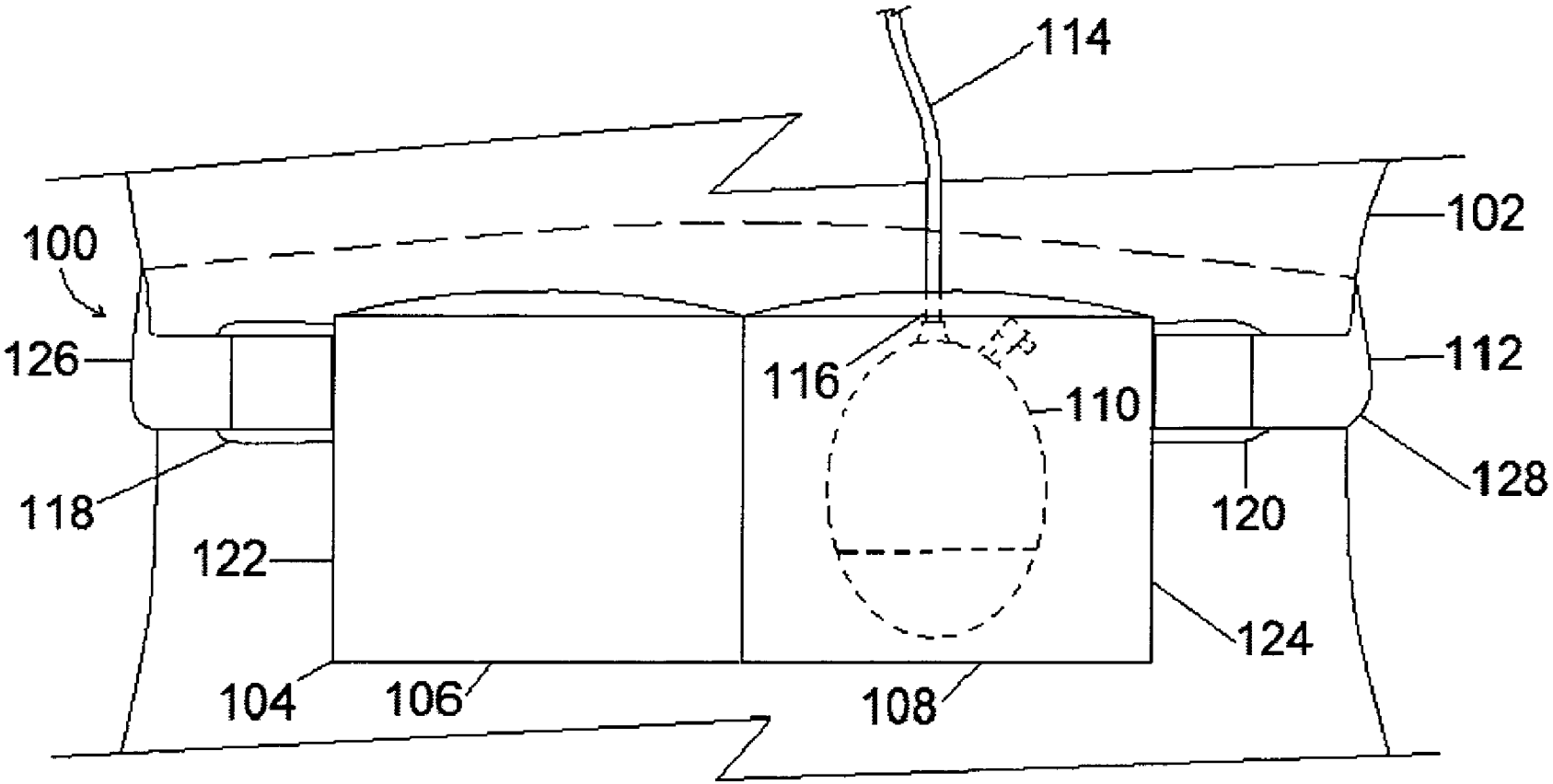
FIG. 1 is a front view of a medical support garment for supporting containers according to an embodiment of the subject matter described herein.

FIG. 1 is a front view illustrating a medical support garment, generally designated 100, for supporting containers according to an embodiment of the subject matter described herein. Referring to FIG. 1, medical support garment is adapted to receive a waist 102 of a patient. Medical support garment 100 can include a medical container holder 104 having at least one pocket, such as pockets 106 and 108. Pockets 106 and 108 can be adapted to hold or support one or more containers, such as a suction drainage container 110 (e.g., a Jackson-Pratt drain or bulb drain) shown in phantom, for storing bodily fluid output from the patient to the containers. As described in further detail below, belt 112 can be attached to medical container holder 104 such that pockets 106 and 108 and the containers held therein are securely held adjacent to waist 102.

One end (not shown) of drain tube 114 can be inserted within the patient for receiving bodily fluid output from the patient. At the inserted end of tube 114, the tube 114 can be secured to the patient's body by sutures (not shown) or other suitable technique. The bodily fluid can travel through tube 114 and exit at an end 116. Drain tube end 116 can be fluidly connected to container 110 for draining fluid received from the patient into the interior of container 110.

As a result of being connected to container 110, which is held in pocket 108, end 116 can be securely held in position adjacent waist 102. Movement of drain tube 114 is restricted because both ends of tube 114 are held adjacent to the torso of the patient. Therefore, the tugging of tube 114 is minimized for reducing pain, discomfort or injury to patient at the connecting suture.

Medical container holder 104 can include loops 118 and 120 that are permanently attached to ends 122 and 124, respectively, of holder 104. Belt 112 can include ends 126 and 128 adapted for releasable attachment to loops 118 and 120, respectively. In one example, ends 126 and 128 can include hook and loop material (such as VELCRO® material) (not shown) adapted for attaching first and second ends 126 and 128 to loops 118 and 120, respectively. As a result, the ends of the belt can be attached to and detached from the ends of medical container holder. This feature is advantageous, for example, when a medical practitioner disconnects the drain tube from the container for facilitating the emptying fluid from the container.

An advantage of releasable attachment of two ends of the holder is that the holder can easily be removed from a bed-bound patient. While the patient lies on his or her back or side, the ends of the holder can be detached from the belt, and the holder removed. The belt can remain underneath the patient until reattachment of the holder.

Figure 2:
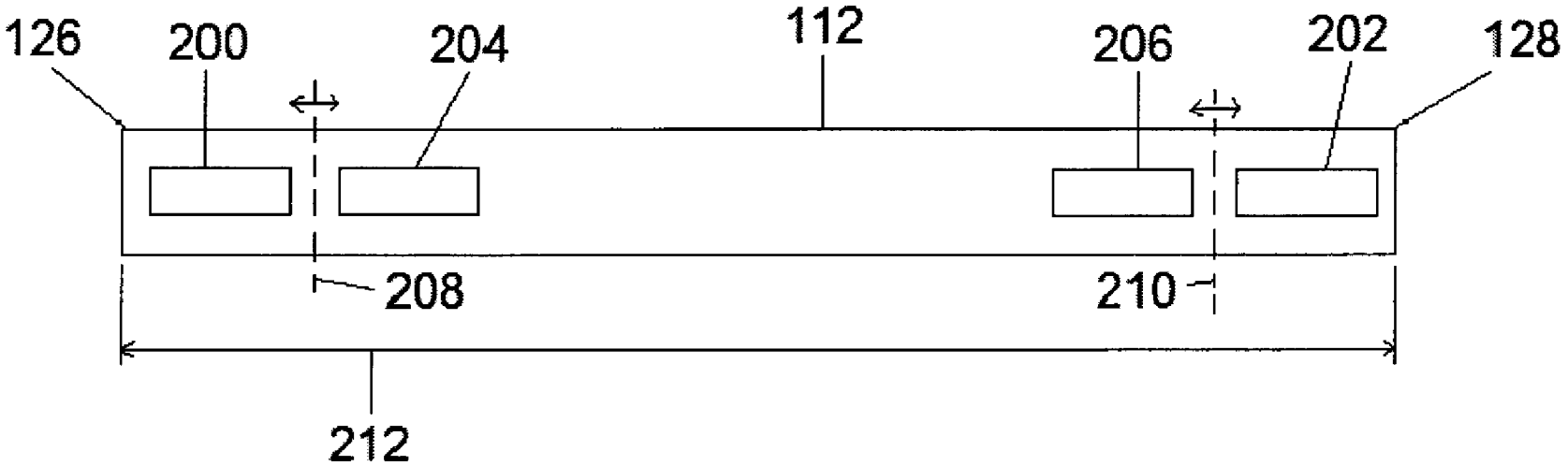
FIG. 2 is a back view of a belt including hook and loop material according to an embodiment of the subject matter described herein.

Medical support garment 100 can be fitted to patients of differing sizes. For example, a length of belt 112 can be adjustable to a size for fitting to any given patient. FIG. 2 is a back view illustrating belt 112 including hook and loop material according to an embodiment of the subject matter described herein. Referring to FIG. 2, belt 112 includes hook material 200 and 202 and loop material 204 and 206, which can be used for attaching belt 112 to loops 118 and 120 of medical container holder 104 shown in FIG. 1. To attach belt 112 to medical container holder 104, ends 126 and 128 can be inserted through loops 118 and 120, respectively. After insertion of the ends though the loops, ends 126 and 128 can be folded over at folds 208 and 210 (indicated by broken lines) such that the hook and loop material contact and attach to one another. For example, hook material 200 and 202 can attach to loop material 204 and 206, respectively.

The position of folds 208 and 210 can be anywhere along the length of belt 112 as long as hook material 200 and 202 can attach to loop material 204 and 206, respectively. Fold positions 208 and 210 correspond to loops 118 and 120, respectively. As a result of adjusting the fold positions, belt 112 can be adjusted for fitting to patients of varying sizes.

Belt length can be a suitable length for fitting to a patient. For example, belt 112 can be different lengths for adults or children. In a child version, a total length 212 can be about 22 inches to about 25 inches. In an adult version a total length 212 can be about 30 inches.

In one embodiment, belt 112 can be a standard length of about 30 inches or greater. The ends of the belt can be cut to any suitable length for fitting to a patient of any size. An end should be cut such that at least a portion of hook and loop material remain attached to the belt.

Figure 3:
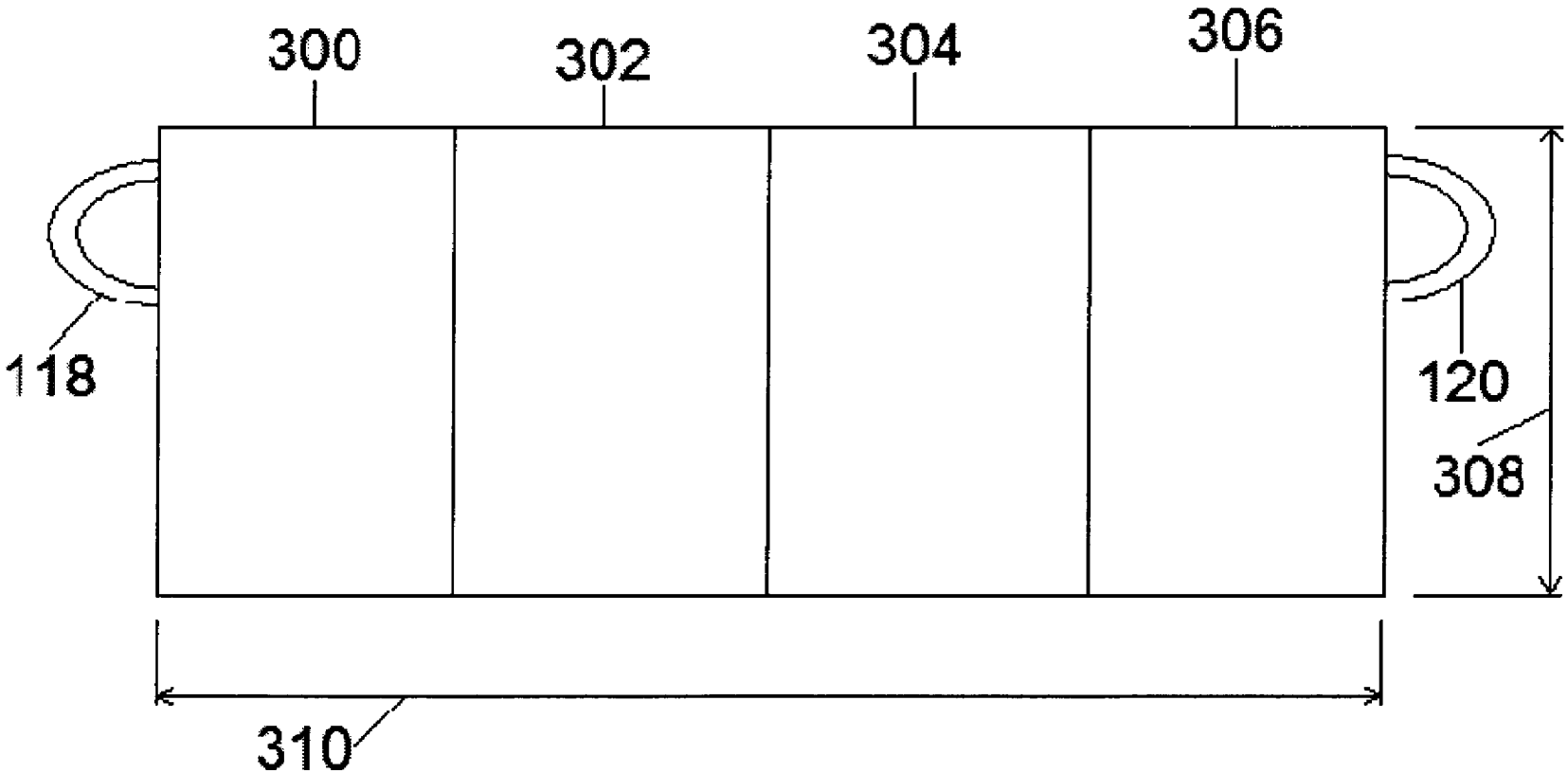
FIG. 3 is a front view of a medical container holder according to an embodiment of the subject matter described herein.

FIG. 3 is a front view illustrating medical container holder 104 according to an embodiment of the subject matter described herein. Referring to FIG. 3, holder 104 includes four pockets 300, 302, 304, and 306, although holder 104 can include any suitable number of pockets (e.g., 8 or more) suitably sized to hold containers. An interior depth distance 308 of the pockets can be between about 5.5 inches and about 6 inches. A width distance 310 of holder 104 from end-to-end can be between about 20 inches and about 40 inches.

Figure 4:
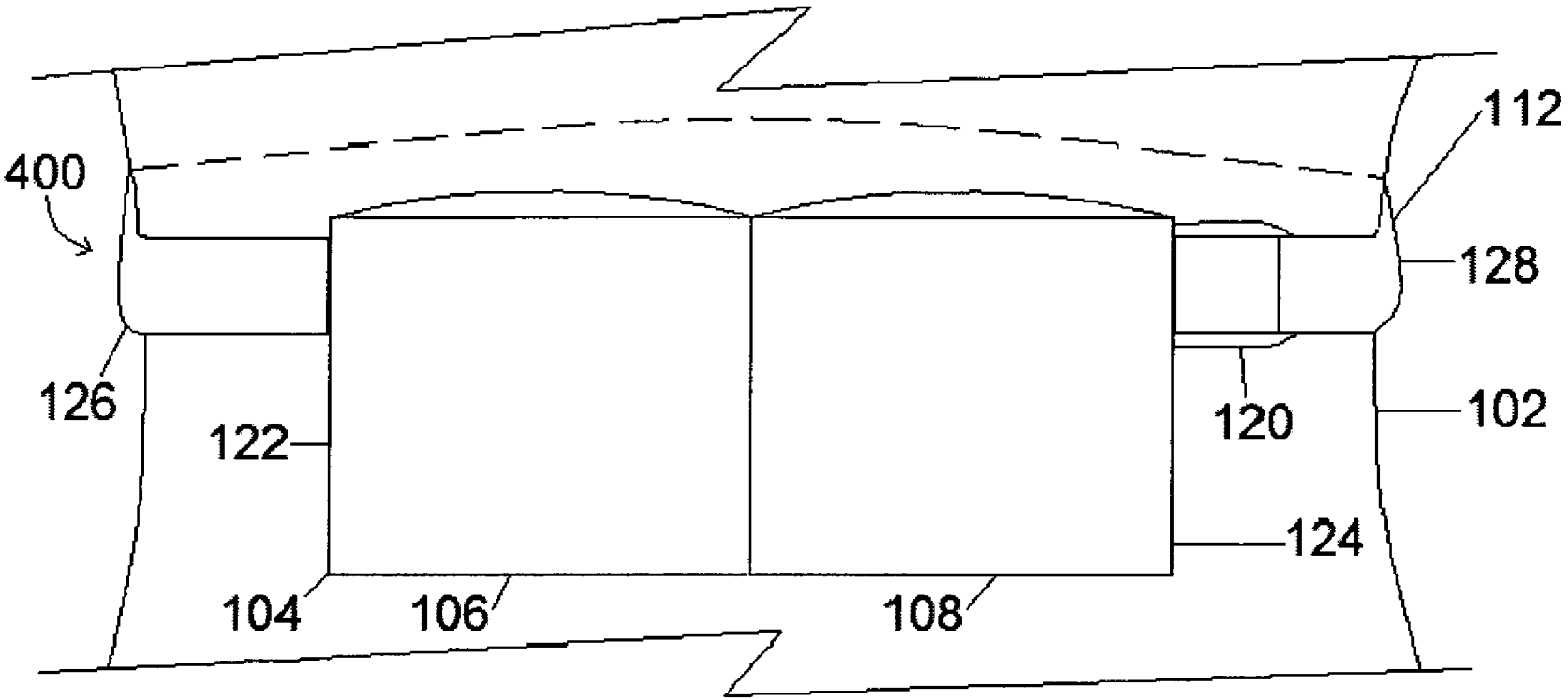
FIG. 4 is a front view of a medical support garment for supporting containers according to another embodiment of the subject matter described herein.

FIG. 4 is a front view illustrating a medical support garment, generally designated 400, for supporting containers according to another embodiment of the subject matter described herein. Referring to FIG. 4, belt 112 includes ends 126 and 128. The medical support garment of this embodiment differs from the embodiment shown in FIG. 1 in that end 126 is permanently attached to end 122 of holder 104. Further, holder 104 of garment 400 does not include loop 118 shown in FIG. 1. The length of belt 112 can be adjusted at end 128 by use of the hook and loop material described above.

Figure 5:
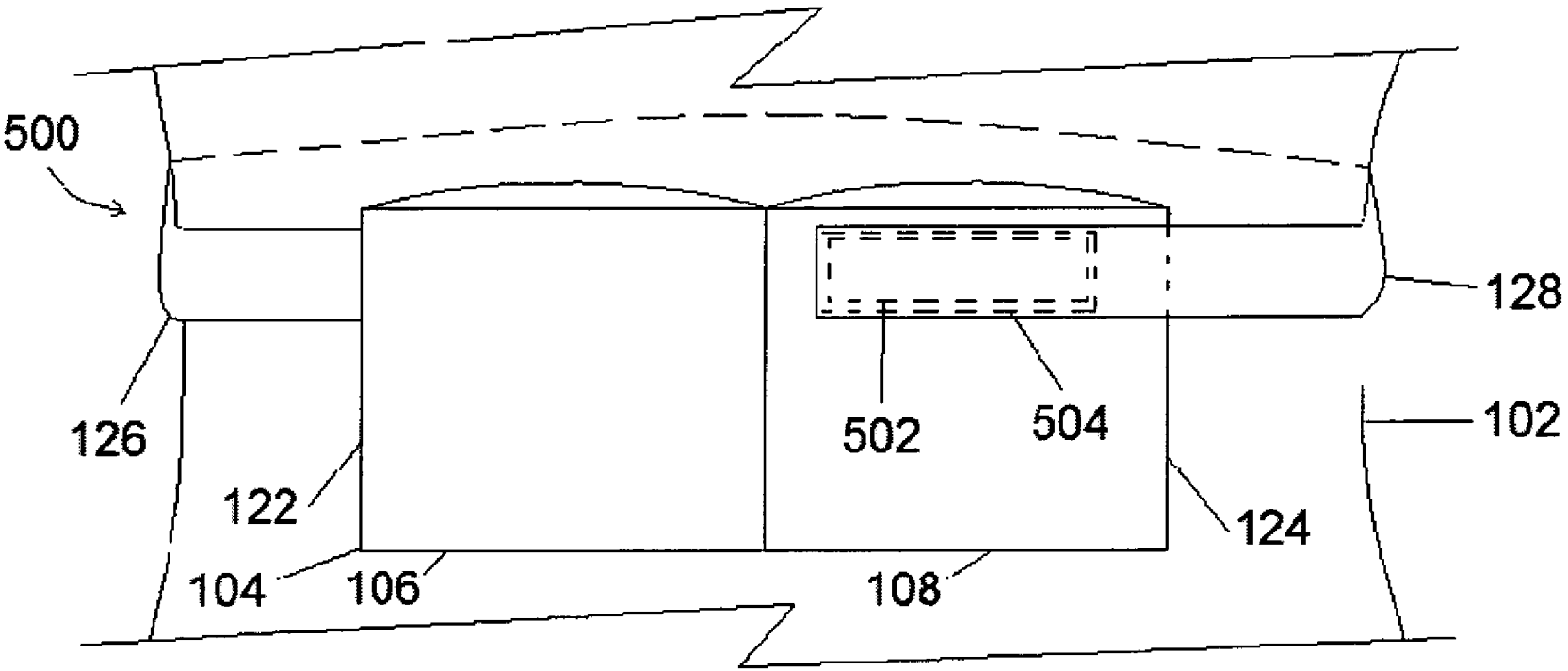
FIG. 5 is a front view of a medical support garment for supporting containers according to another embodiment of the subject matter described herein.

FIG. 5 is a front view illustrating a medical support garment, generally designated 500, for supporting containers according to another embodiment of the subject matter described herein. Referring to FIG. 5, belt 112 includes ends

126 and 128. The medical support garment of this embodiment differs from the embodiment shown in FIG. 4 in that holder 104 does not include loop 120 shown in FIG. 4 and end 128 is attachable to holder 104 by hook and loop material. In particular, holder 104 can include hook material and/or loop material 502 shown in phantom, and end 128 can include the other of hook or loop material 504 shown in phantom. The length of belt 112 can be adjusted at end 128 by varying the contact point of the hook and loop material of end 128 and holder 104.

A top portion of a pocket can include an open end for insertion of a container and for allowing a drain tube to be connected to the container. Further, in one embodiment, a holder can include a fastener assembly adapted to at least partially close the open end of the pocket for holding the container in the pocket. An example of a fastener assembly can include hook and loop material that can be contacted for at least partially closing the open end of the pocket.

In another embodiment, the ends of a medical container holder can be permanently attached to the ends of a pair of strings. The strings can be adapted to extend around a patient's waist and can be adapted to tie the other ends of the strings together for holding the medical container holder adjacent to the patient's waist. The strings can be of a suitable length and material for fitting around the patient's waist and for securely tying together.

The medical support garment can be made of any material suitable for medical clothing applications. For example, the material can be a water-resistant material, such as a nylon fabric for bathing, or of a cloth composition for non-bathing activities, such as day and night wear. In another example, all or a portion of a medical support garment as described herein can be made of woven fabric or material. In another example, all or a portion of a medical support garment as described herein can be made of a flame resistant material.

It is noted that various features of the foregoing embodiments were discussed separately for clarity of description, and they can be incorporated in whole or in part into a single embodiment of the subject matter described herein having all or some of these features. Further, it is noted that the use of the medical support garment described herein is not limited to breast operations but can be readily used in conjunction with any medical drainage device that is externally attached to a patient's body, such as catheters, and any container adapted to receive the outputs from drainage devices.

It will be understood that various details of the presently disclosed subject matter may be changed without departing from the scope of the presently disclosed subject matter. Furthermore, the foregoing description is for the purpose of illustration only, and not for the purpose of limitation.

What is claimed is:

1. A medical support garment comprising:

a medical container holder including first and second ends and at least one pocket that carries at least one container therein for storing bodily fluid output from a patient;

a drain tube fluidly connected to the container and configured for passing the bodily fluid output from the patient to the container; and a belt including first and second ends adapted for releasable attachment to the first and second ends, respectively, of the medical container holder such that the pocket is held adjacent to the waist of the patient when the first and second ends of the belt are attached to the first and second ends, respectively, of the medical container holder.

2. The medical support garment of claim 1, wherein the pocket includes an open end having a fastener assembly adapted to at least partially close the open end of the pocket for holding the container in the pocket.

3. The medical support garment of claim 1, wherein the pocket has an interior depth of between about 5.5 inches and about 6 inches.

4. The medical support garment of claim 1, wherein the medical container holder includes a plurality of pockets, each of the pockets being adapted to support an associated container for storing bodily fluid output from a patient to the associated container.

5. The medical support garment of claim 1, wherein the medical container holder has a width of 12 inches or greater between the first and second ends.

6. The medical support garment of claim 1, wherein the belt is adjustable to fit to the waist of the patient for holding the pocket to the waist of the patient.

7. The medical support garment of claim 1, wherein the first and second ends of the belt each include hook and loop material adapted for attaching the first and second ends of the belt to the first and second ends, respectively, of the medical container holder.

8. The medical support garment of claim 7, wherein the medical container holder includes first and second loops attached to the first and second ends, respectively, wherein the first and second ends of the belt are adapted to be inserted through the first and second loops, respectively, and wherein the first and second ends of the belt are each adapted to be folded over such that the hook and loop material contact for attaching the belt to the medical container holder.

9. The medical support garment of claim 1, wherein the belt has a width of at least 22 inches.

10. The medical support garment of claim 1, wherein the belt has a width of between about 22 inches and 30 inches.

* * * * *